United States Patent [19]

Walter

[11] Patent Number: 4,865,402

[45] Date of Patent: Sep. 12, 1989

[54] SHOWCASE FOR THE DISPLAY OF MERCHANDISE

[75] Inventor: Herbert Walter, Müllheim, Fed. Rep. of Germany

[73] Assignee: Protoned B.V., Amsterdam, Netherlands

[21] Appl. No.: 154,139

[22] Filed: Feb. 9, 1988

[30] Foreign Application Priority Data

Feb. 12, 1987 [CH] Switzerland ..... 518/87

[51] Int. Cl.[4] ..... A47F 3/00

[52] U.S. Cl. ..... 312/140; 312/263; 312/264; 312/257.1

[58] Field of Search ..... 312/257.5 K, 140, 126, 312/128, 138 R, 257 R, 263, 264, 265; 108/111

[56] References Cited

U.S. PATENT DOCUMENTS

| | | | |
|---|---|---|---|
| 2,956,705 | 10/1960 | Clingman | 312/257.5 K X |
| 3,896,743 | 7/1975 | Pariente | 108/111 |
| 4,187,649 | 2/1980 | Chaffee | 312/140 X |
| 4,291,928 | 9/1981 | Kiyosawa . | |
| 4,368,936 | 1/1983 | Worrallo | 312/140 X |
| 4,509,806 | 4/1985 | Dudouyt | 108/111 X |
| 4,553,680 | 11/1985 | Griggs et al. . | |
| 4,556,148 | 12/1985 | Koller | 108/111 X |
| 4,637,324 | 1/1987 | Janson | 108/111 |

FOREIGN PATENT DOCUMENTS

| | | |
|---|---|---|
| 8600246 | 4/1986 | Fed. Rep. of Germany . |
| 944942 | 4/1947 | France . |
| 1282146 | 12/1960 | France . |

*Primary Examiner*—Peter A. Aschenbrenner
*Assistant Examiner*—Thomas A. Rendos
*Attorney, Agent, or Firm*—Ralph W. Selitto, Jr.

[57] ABSTRACT

The merchandise display showcase composed of standard parts and having a base part (1, 2), corner columns (3) and glass walls (8) is equipped, between the base part and a cover plate (7), with a crossmember element (4) for stabilizing the corner columns (3). The corner columns (3) composed of a core tube and of a sectional guide bar surrounding this for the mounting of the glass walls (8) are fastened, at the bottom, at prepositioned assembly locations in the base part (1, 2) and carry, on their top side, a plate-shaped cover means (7) interconnected releasably via a connecting element present partially on the core tube and partially on a cover plate.

13 Claims, 5 Drawing Sheets

Figure 5:
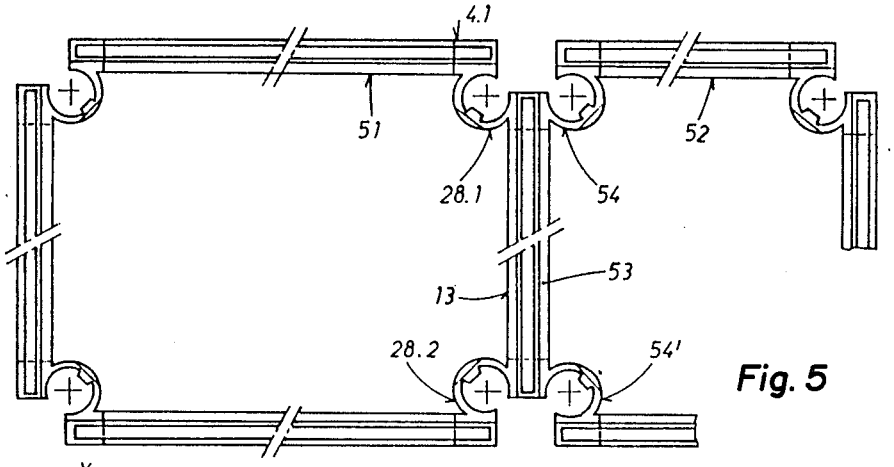

Fig. 2
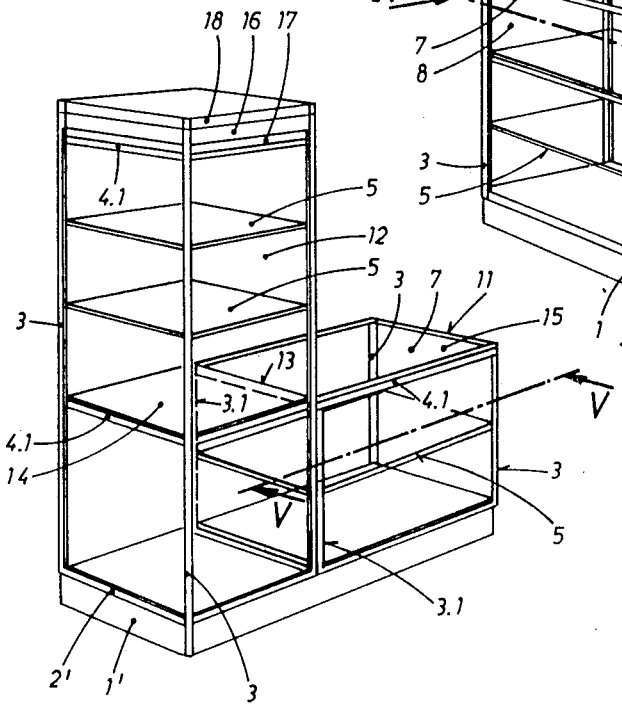
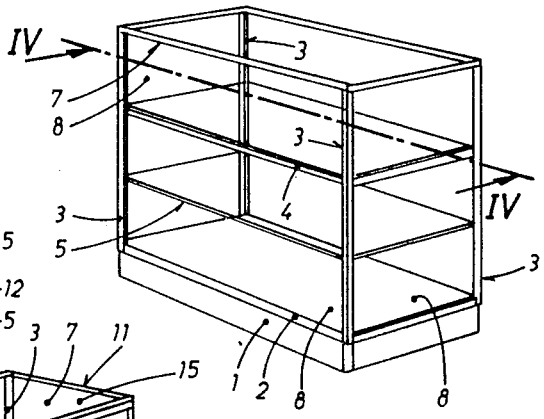
Fig. 1
Fig. 4
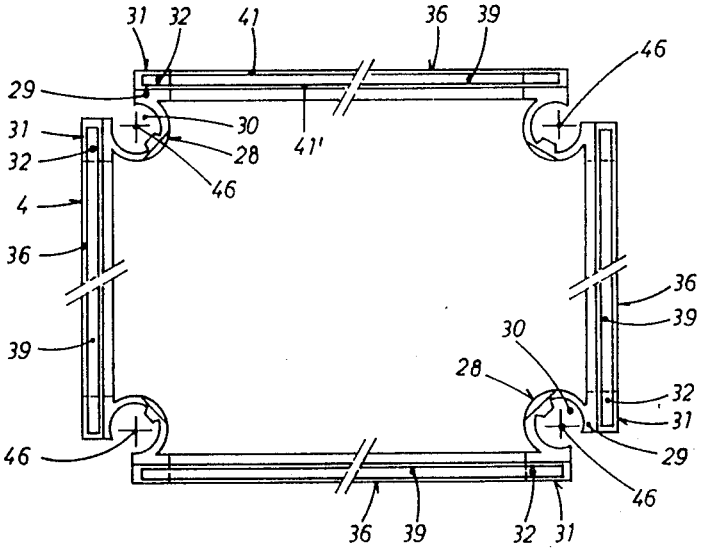

Fig. 6 a
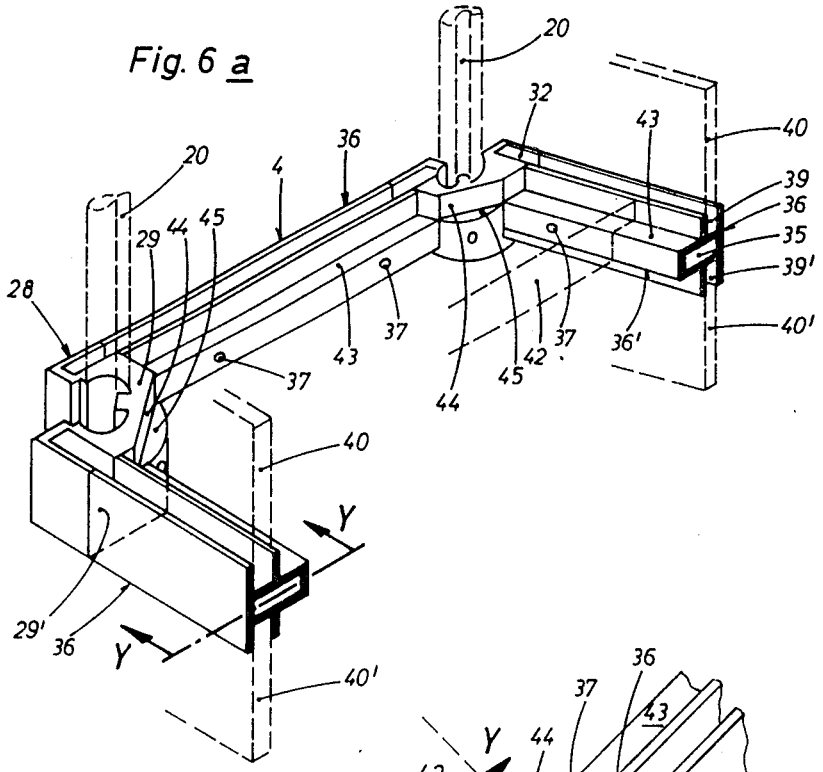
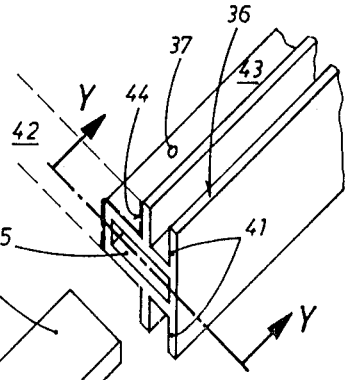
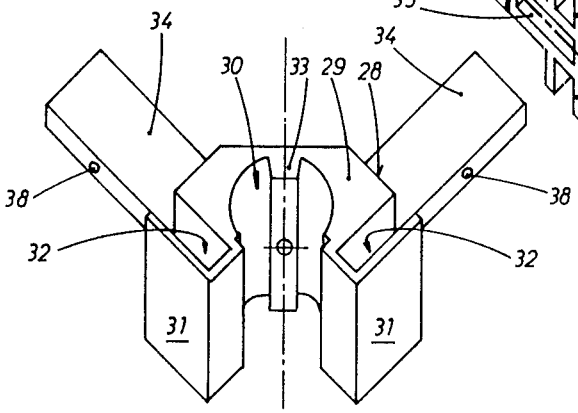
Fig. 6 b

Fig. 8a
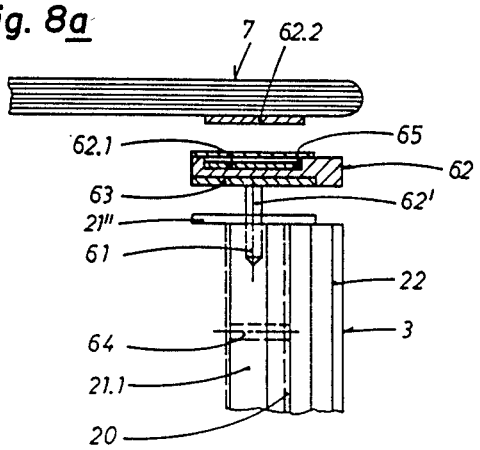
Fig. 8c
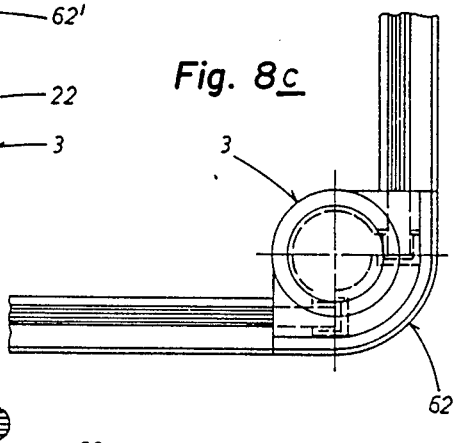
Fig. 8b
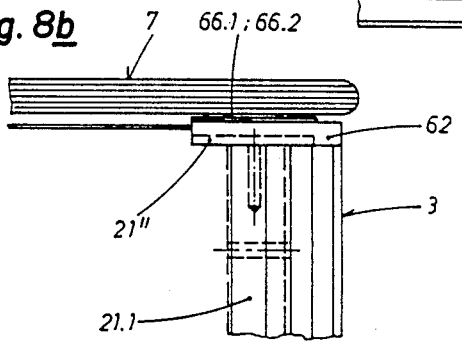
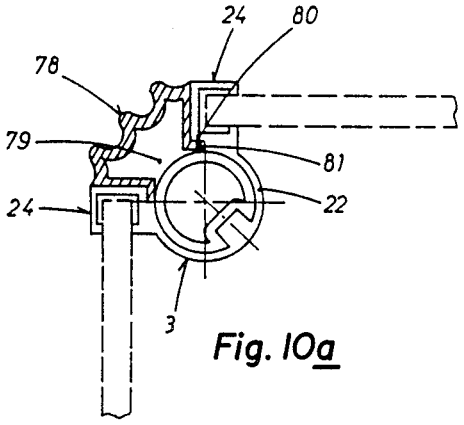
Fig. 10a
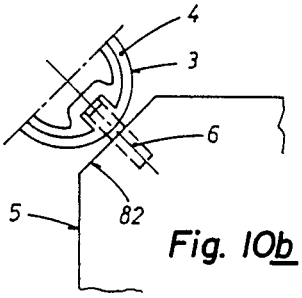
Fig. 10b

SHOWCASE FOR THE DISPLAY OF MERCHANDISE

The application relates to a showcase for the display of merchandise, according to the pre-characterizing clause of patent claim 1.

It is known to use showcases of this type for the display of merchandise, for example pastry articles, which does not have to be frozen, to be protected against environmental influences, such as dust, smoke or smells, or valuables, such as jewelry, coins, postage stamps and the like. On the market there are showcases which are designed as single-space furniture or as add-on arrangements and which are equipped either only with a glass door or also with glass walls. There are also known showcases composed, according to the building-block system, of standard parts from which, in principle, block structures of any design can be produced.

The object of the present invention is to provide a showcase for the display of merchandise, which can be constructed and extended essentially in the last-mentioned way, in particular the corner and subdivision regions being composed of sectional elements which allow effective sealing against dust and which make it possible to erect a showcase at its place of installation without adaptation work and/or reworking.

The solution according to the invention for achieving this object is defined by the characterizing features of patent claim 1. Embodiments thereof emerge from the dependent claims.

An exemplary embodiment and details of this are described below with reference to the drawing.

Figure 3A:
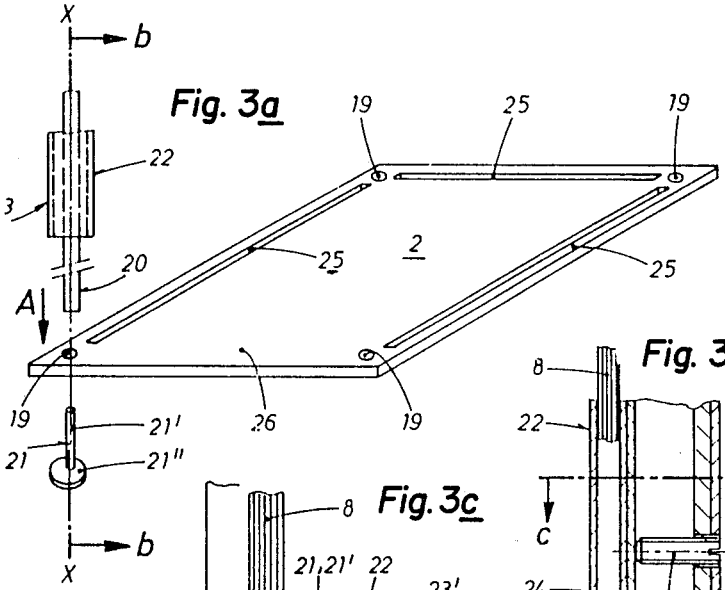
Figure 3C:
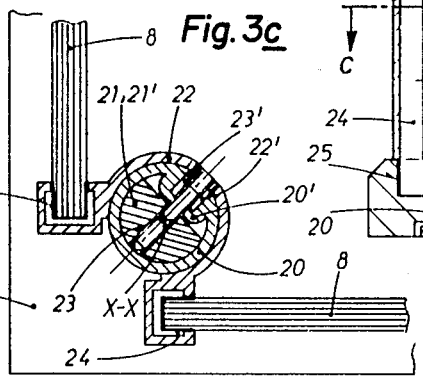
Figure 9:
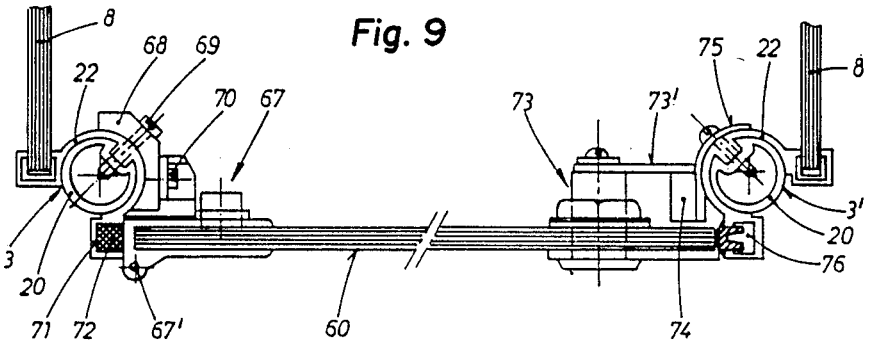
Figure 7A:
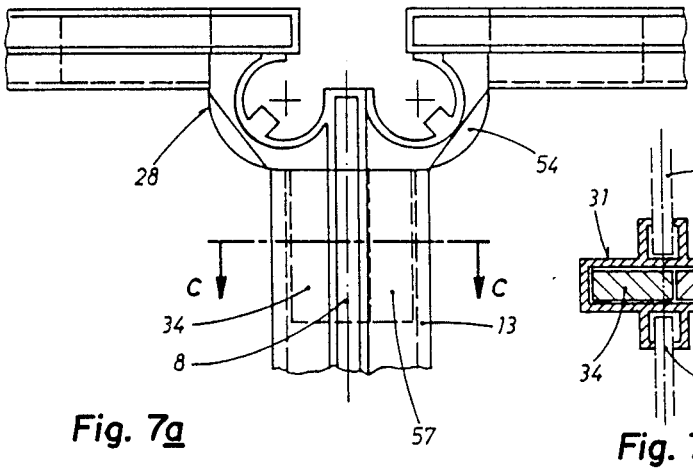

In the drawing:

FIGS. 1 and 2 show, in a diagrammatic perspective representation, two exemplary embodiments of showcases designed according to the invention, FIGS. 3*a* and 3*c* show (a) in a perspective exploded representation (b) in longitudinal section and (c) in cross-section, a baseplate made of wood for a lockable showcase according to FIG. 1, with a column element and its design, FIGS. 4 and 5 show diagrammatically the design of a crossmember frame element in sections along the lines IV—IV and V—V of FIGS. 1 and 2, FIGS. 6*a* and 6*b* show partial representations of a corner-column crossmember element for column stabilization and a shelf rest, corner pieces being shown in the assembled state (a) and in the exploded position (b), FIGS. 7*a, b* and *c* show the formation of a showcase extension by means of a partition supporting crossmember element, FIGS. 8*a, b* and *c* show the formation of a cover plate, FIG. 9 shows a door fitting with a door hinge and a door stop/lock, and FIGS. 10*a* and 10*b* show a corner cladding section in a cross-section through the supporting column (a) and a detail of a glass shelf rest (b).

In the figures, identical parts are designated by the same reference numerals.

For a showcase according to FIG. 1 it comprises a frame-shaped (hollow-bodied) base 1, on the top of which is placed a baseplate 2, for example a baseplate according to FIG. 3*a*. When such a baseplate is used, it is appropriately connected fixedly to the base frame. As mentioned later, the showcase can also be designed without a base frame 1. Corner columns 3 are attached to the baseplate 2 essentially in the way explained according to FIGS. 3*a* to *c*. To stabilize the showcase structure, a corner-column crossmember element 4 which is designed essentially according to FIG. 6 (*a,b*) and which can therefore appropriately also be used as a shelf rest is installed at a suitable vertical distance from the baseplate 2. Further showcase height divisions can preferably be provided by means of glass shelves 5 which, as shown in FIG. 10*b*, are supported by pegs 6 (not shown in FIG. 1) inserted into the corner columns 3. At the top of the showcase it is equipped with a cover plate 7 which can be designed, for example, according to FIGS. 8*a* to 8*c* and which can be fastened on the corner columns 3. Furthermore, such a showcase can be equipped with glass walls partially or on all sides, and in the latter case one wall must be provided as a door aperture, of which FIG. 9 shows an example of the design and which respectively allows access to at least one showcase compartment.

The showcase according to FIG. 2 is designed as two-component furniture with a low body 11 and a towerlike extension 12 connected in one piece to the body 11. It goes without saying that "showcase landscapes" of virtually any shape, as seen in a plan view and in profile, can be created in this way. These are intended to be represented by FIGS. 1 and 2. FIG. 2 shows a base 1' which extends over the region of horizontal projection of the body 11 and of the extension 12 and which carries a baseplate 2' also, if need be, extending over the entire horizontal projection of the showcase. The corner columns 3 located on the outside on the multi-component furniture according to FIG. 2 are basically of the same design as those on an individual piece of furniture according to FIG. 1, whilst corner-column portions 3.1 located on the inside in connection regions between the furniture components are designed as so-called double columns according to FIGS. 7*a* to *c*. There, the cross-member element 4.1 forming a frame is divided by means of a subdivision crossmember 13 into a double (multiple) frame with two zones 14 to 15, the zone 14 being designed as a shelf zone and zone 15 as a cover-plate zone. Both the body 11 and the extension 12 can be equipped with glass shelves 5. Both the body 11 and the extension 12 can be covered with a cover-plate 7 according to FIGS. 8*a* to *c*. However, FIG. 2 illustrates the latter with a covering structure, in which a lighting ceiling 16 with a lower spotlight plate 17 and an upper fixture plate 18 is arranged on a frame-shaped crossmember element 4.1.

Figure 3B:
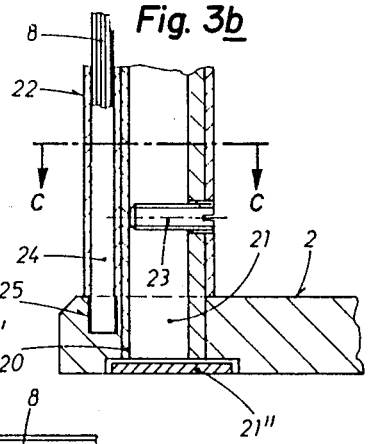

FIGS. 3*a* to *c* show how a corner column 3 is attached to a baseplate 2. The baseplate 2 is provided, in its corner regions, with bores 19 which are aligned exactly with the desired corner-column axes x—x. Their diameter is selected so that a sectional core tube 20, preferably made of steel, can be inserted into them with a sliding fit (arrow A). This core tube 20 is equipped with an assembly pin 21 which has a part-cylindrical cross-section (FIG. 3*c*) in its connection region 21'. The assembly pin 21 carries a stop plate 21'' at one end, is screwed to the core tube 20 and by means of the stop plate 21'' is prevented from being pulled out of the baseplate 2. The core tube 20 extends in one piece over the entire height of the showcase and, together with a second assembly pin 21.1 located at the top (see FIGS. 8a and b for this), guarantees that the components of the showcase are held together vertically. A sectional guide bar 22 is pushed on over the core tube 20 and attached to the baseplate 2. The sectional guide bar 22, the core tube 20 and the assembly pins 21, 21.1 are appropriately screwed to one another by means of two hexagon-socket screws 23, 64.

The sectional guide bar 22 has two longitudinal glass-wall channels 24 formed on so as to project outwards at an angle of approximately 90° and each intended for the lateral guidance of a glass wall 8. The sectional bar 22 surrounds the core tube 20 over approximately three quarters of its circumference and thus forms a kind of open jacket round the core tube 20. The section orifice remaining as a result is characteristic of all the components of the showcase which are arranged round the core tube 20, at least above the baseplate 2 and below the column covering. See FIGS. 4, 5, 6 and 7 for this. As described later with reference to FIG. 10*a*, this orifice can be masked by means of a decorative sectional cover bar.

The baseplate 2 is provided with grooves 25 which extend outside the core-tube bores 19 and are aligned with matching grooves 24 in the sectional guide bar 22 and which serve for receiving glass walls 8. FIG. 3*a* shows three such grooves 25. The front region 26 intended for the fitting of a door is therefore not provided with a groove 25.

In order, on the one hand, to prevent the sectional guide bar 22 from rotating on the core tube 20 and, on the other hand, to make it possible to attach these two components on the assembly pin 21 with the correct fit in order to screw them to one another, the core tube 20 has a groove 20′ engraved in it and the sectional guide bar 22 has a rib 22′ projecting inwards and engaging into the groove 20′. This emerges from all the relevant figures of the drawing, especially from FIG. 3*c*. There still remains in the core tube 20, for the assembly pin 21 engaging in to the core tube 20, a receiving space of approximately semicircular cross-section which is located opposite the bottom (not designated) of the groove 20′ and which can thus receive the connection region 21′ of the assembly pin 21 in a rotation-preventing manner.

The just-mentioned means for preventing the rotation of the corner-column components 20, 21, 22 also perform the function of forming receiving locations for the screw of screws 23. Thus, the rib 22′ contains a number of threaded holes 23′, two of which match corresponding threaded holes in the assembly pin 21. Corresponding through-holes, into which the screws 23 engage, are provided in the groove bottom of the core tube 20. Tightening the screws 23 from the inside of the showcase results in a rigid composite corner-column structure in the region of the assembly pin 21. A composite structure of similar effect is obtained accordingly in the corner-column termination located underneath the cover-plate 7 according to FIGS. 8*a* to *c*.

The rib 22′ contains, in addition to the threaded holes 23′, further threaded holes (not shown) for selectively receiving shelf-rest pegs 6 shown in FIG. 10*b*.

FIGS. 4 and 5 (sections IV—IV and V—V in FIGS. 1 and 2) show, in a diagrammatic representation, the design of crossmember element frames 4, 4.1 for showcases of the type illustrated in FIGS. 1 and 2. For a single element frame according to FIG. 1, reference may also be made to FIGS. 6*a* and 6*b*. On block-shaped corner pieces 28, one of which is shown in FIG. 6*b* in a perspective representation, there is, in a housing body 29, a receiving orifice 30, the inner contour of which corresponds exactly to the inner contour of the sectional guide bar 22 (FIG. 3*a*). In other words, the receiving orifice 30 has a cross-sectional shape matching the contour of the core tube 20 (FIG. 3*c*). The core tube 20 can therefore be pushed through this orifice.

Formed on the housing body 29 essentially symmetrical relative to a frame mid-plane y—y (FIGS. 6*a* and 6*b*) are grooved lugs 31 which are at rightangles to one another and which are provided with groove recesses 32 on their top side and on their under side. FIG. 6*b* shows only the upper recesses 32. The rib 33 corresponds to the rib 22′ in the sectional guide bar 22. Coupling tenons 34 oriented in the direction of the groove recesses 32 are matched in terms of cross-section to the central orifice 35 in a crossmember 36, the tenons 34 being intended to engage into the said recess. By means of setscrews (not shown) inserted in threaded bores 37′ and engaging into blind-hole bores 38, four particular crossmembers 36 and four particular corner pieces 28 are screwed together to form a corner-column crossmember 4.

The crossmember 36 comprises a rectangular-tube section with the central orifice 35. Upper and lower channels 39, 39′ for receiving glass walls 40, 40′ are arranged on the rectangular tube 36′ shown horizontal. The two channels 39, 39′ are aligned with the associated groove recesses 32 in the housing body 29 of the corner pieces 28 and are thus each part of the mounting of the adjacent glass wall 40, 40′. In a similar way to the design of the grooved lugs 31 on the housing body 28, the outer groove walls 41 are flush with the adjacent rectangular-tube wall and together with this form a plane surface. The inner and upper groove walls 41′ can be used as stop members for a shelf plate 42, as the supporting surface 43 of which the top of the rectangular tube 36′ can be used.

The shelf plate 42, basically rectangular as seen in a plan view, is equipped with beveled corners 82 (FIG. 10*b*), opposite which are arranged bevels 44 on the housing body 29 of the corner piece 28. the supporting surface 45 arranged under this bevel and at rightangles to it is in the same plane as the supporting surface 43 of the crossmember 36.

We now refer back to FIGS. 4 and 5. Of these, FIG. 4 shows the crossmember element 4 for a showcase according to FIG. 1 in the form of a single frame which is substantially described above by means of the details from FIGS. 6*a* and 6*b*. The cornerpieces 28 are arranged in four corner regions grouped round the centers 46. Between these corner pieces extend the crossmembers 36 which each contain a glass-wall channel 39, 39′ open downwards and upwards. All four corner pieces 28 are identical and are designed according to FIGS. 6*a* and 6*b* and are screwed together with the cross-members 36 to form the said dimensionally stable frame-shaped crossmember element 4.

FIG. 5 illustrates as a whole the cross-member element 4.1 which comprises a portion 51 (on the left) and a portion 52 (on the right). The portion 52 can also be designated as an extension protion. The portion 51, with the exception of the subdivision crossmember 13, is basically constructed from the same components as the crossmember element 4 according to FIG. 4. On the other hand, according to FIGS. 7*a* to *c* the extension region has a so-called partial corner piece 54 which makes it possible to connect the or a further showcase portion. FIG. 7*b* shows, on the left of the glass wall 8, a corner piece 28 of the same design as in FIG. 6*b*. The glass wall 8 is guided in the region of the corner piece in the groove recess 32. On the right of the glass wall 8, the partial corner piece 54 is shortened on one side by a portion approximately corresponding to the width of the groove recess 32. This shortening also results in a reduction in the width of the second coupling tenon by approximately one third of the "normal width". This second coupling tenon is designated by 57 in FIG. 7*b* which shows the two corner pieces 28 and 54 in the exploded state. The partial corner piece 54 corresponds in terms of its remaining shape to the corner piece 28.

Figure 7C:
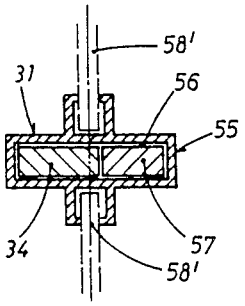
Figure 7B:
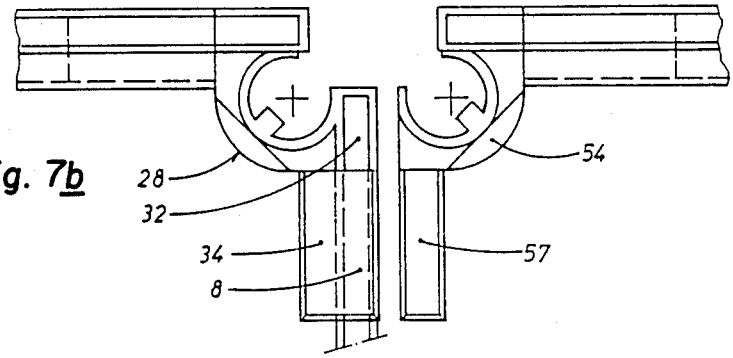

The "normal" corner piece 28 and the partial corner piece 54 are assembled together, according to FIG. 7*c*, by means of a tubular-section crossmember 55, in the orifice 56 of which the first coupling tenon 34 and the second coupling tenon 57 lie next to one another and are secured relative to one another. A respective glass-wall channel 58, 58' is formed on centrally above the central orifice 56.

It goes without saying that the corner piece 54' at the other end of the crossmember 53 must be designed according to the corner piece 54 (FIG. 5), in order to obtain the same connection conditions as on the latter.

For building on further showcase units, the constructional details, as described above, are repeated. It is also possible to vary the forms, as seen in horizontal projection, of showcase combinations up to 90° by means of angled extensions (not shown), if the respective partial corner pieces 54, 54' are matched to the desired angles.

FIGS. 8*a* to *c* show the provision of a coverplate rest at the top end of a 90°-corner column 4. In the exploded representation according to FIG. 8*a*, the assembly pin 21.1 provided with a threaded bore 61 is inserted into the core tube 20 represented by a broken line, in such a way that its stop plate 21'' rests on the top of the core tube 20 and of the sectional guide bar 22. A column end plate 62 with a centering peg 62' is held on the assembly pin 21 as a result of the insertion of this peg into the threaded bore 61 and can be attached onto the corner column 3 so that the outer contours of the end plate 62 and of the corner column 3 essentially cover one another (FIGS. 8*b* and *c*). The column end plate 62 has, on its underside, a recess 63, into which the stop plate 21'' fits. As a result of the engagement of the centering peg 62' in the threaded bore 61, the column end plate 62 is retained on the assembly pin 21 which is itself screwed to the core tube 20 by means of a setscrew 64.

The column end plate 62 has, on its to side, a further recess 65, in which one half 66.1 of a touch-and-close fastener is glued. The other half 66.2 of the touch-and-close fastener is glued with an exact fit onto the underside of the cover plate 7. In the assembled state according to FIG. 8*b*, the two halves 66.1 and 66.2 of the touch-and-close fastener engage firmly into one another with an adhesive effect, and the resulting bond between the cover plate 7 and the corner column 4 prevents the cover plate from accidentally sliding off from the corner column or being removed from the latter without authorisation.

FIG. 9 shows, in a view from above, how a showcase door 60 can be fitted in a showcase zone instead of a glass wall 8. 3 and 3' denote corner columns composed of core tube 20 and of sectional guide bar 22. The corner column 3 (on the left) is equipped with a conventional snap hinge 67 with an outer center of rotation 67', the said hinge being attached to the corner column 3 by means of an adapter member 68 and screws 69, 70. The glass-wall channel 71 located on the same side as the door is appropriately equipped with a rubber gasket 72 which forms a flexible lateral closing seal for the door.

On the same side as the corner column 3' (on the right), the door is equipped with a likewise conventional safety lock 73, the catch 73' of which engages behind a door stop 74 in the closed position. This door stop is part of a stop plate 75 which surrounds a rear portion of the corner column 3' and which is screwed to this. The glass-wall channel 76 located on the same side as the lock is appropriately equipped with a sectional rubber gasket 77 which can form both a closing seal for the door and a closing brake.

FIG. 10 illustrates the arrangement of a sectional cover bar 78 which is inserted into the orifice 79 between the guide grooves 24 of the sectional guide bar 22 (and which closes off this orifice). For the firm anchoring of the sectional cover bar 78, the sectional guide bar 22 has undercuts 80 which are accessible from the orifice 79 and into which engage laterally projecting ribs 81 on the sectional cover bar 78. The sectional cover bar 78 can be made decorative as a result of surface profiling and/or surface coating.

Finally, FIG. 10*b* shows the already previously described possibility for producing the shelf rest inside a showcase space. The peg 6 is screwed into the corner column 3 or its sectional guide bar 4 and supports the glass shelf which is provided with a corner bevel 82 in the region of the corner column.

It goes without saying that an assembly pin 21.1 provided according to FIG. 8*a* with a threaded bore 61 can also be used at the lower end of the corner column, and there the threaded bore can be used to receive a foot rest (not shown) or a running roller.

I claim:

1. A showcase for the display of merchandise, said showcase comprising a base located at a lower end of said showcase;

a cover located at an upper end of said showcase;

a plurality of corner columns extending from said base to said cover;

a plurality of glass panels, each of said glass panels extending between a corresponding pair of adjacent corner columns; and stabilizing means located on said corner columns between said base and said cover for stabilizing said corner columns so as to maintain a substantially constant distance between said corner columns of each pair of adjacent corner columns, said stabilizing means including at least one stabilizing frame, said at least one stabilizing frame including a plurality of corner pieces, each of said corner pieces being mounted n a corresponding one of said corner columns and having a body, an orifice extending longitudinally through said body and being sized and shaped so as to receive said corresponding one of said corner columns, a rib extending laterally into said orifice from said body and engaging a groove provided in said corresponding one of said corner columns, said rib cooperating with said groove so as to prevent said body from rotating relative to said corresponding one of said corner columns, a first stop face located on an external surface of said body and lying in a first plane which is parallel to said corresponding one of said corner columns, a second stop face located on another external surface of said body and lying in a second plane which is parallel to said corresponding one of said corner columns and is perpendicular to said first plane, a first tenon extending outwardly from said first stop face in a direction which is perpendicular thereto, a second tenon extending outwardly from said second stop face in a direction which is perpendicular thereto, a first lug arranged alongside said first stop face and having first receiving means for receiving a bottom edge of one of said glass panels and second receiving means for receiving a top edge of one of said glass panels, and a second lug arranged alongside said second stop face and having third receiving means for receiving a bottom edge of one of said glass panels and fourth receiving means for receiving a top edge of one of said glass panels, and said at least one stabilizing frame also including a plurality of cross members, each f said cross members extending between a corresponding pair of adjacent corner pieces and including a first socket sized and shaped so as to receive said first tenon of one corner piece of said corresponding pair of adjacent corner pieces, a second socket sized and shaped so as to receive said second tenon of the other corner piece of said corresponding pair of adjacent corner pieces, fifth receiving means for receiving a bottom edge of an upper glass panel, said fifth receiving means being in alignment with said first receiving means of said one corner piece and with said third receiving means of said other corner piece, whereby said fifth receiving means cooperates with said first receiving means of said one corner piece and with said third receiving means of said other corner piece to hold said bottom edge of said upper glass panel, and sixth receiving means for receiving a top edge of a lower glass panel, said sixth receiving means being in alignment with said second receiving means of said one corner piece and with said fourth receiving means of said other corner piece, whereby said sixth receiving means cooperates with said second receiving means of said one corner piece and with said fourth receiving means of said other corner piece to hold said top edge of said lower glass panel.

2. A showcase according to claim 1, further comprising a plurality of first connecting means for connecting said corner columns to said cover, each of said first connecting means connecting said cover to a corresponding one of said corner columns, and a plurality of second connecting means for connecting said corner columns to said base, each of said second connecting means connecting said base to a corresponding one of said corner columns.

3. A showcase according to claim 2, wherein each of said first connecting means includes an upper assembly pin positioned in an upper end of a corresponding one of said corner columns and having a stop plate positioned externally of said upper end of said corresponding one of said corner columns, an end plate having on one side thereof a recess sized and shaped so as to receive said stop plate of said upper assembly pin and having on an opposite side thereof a first snap-fastener which is in mating relationship with a second snap-fastener provided on said cover.

4. A showcase according to claim 3, further comprising a plurality of guide bars, each of said guide bars being received on a corresponding one of said corner columns and including a rib which engages said groove in said corresponding one of said corner columns so as to substantially prevent its associated guide bar from rotating relative to said corresponding one of said corner columns.

5. A showcase according to claim 4, wherein the lateral cross-sectional shape of said guide bars substantially matches the lateral cross-sectional shape of said corner pieces.

6. A showcase according to claim 4, wherein each of said corner columns includes a core tube extending between said base and said cover, each of said core tubes being sized and shaped s as to receive a corresponding one of said guide bars.

7. A showcase according to claim 6, wherein each of said second connecting means includes a lower assembly pin non-rotatably received n a lower end of a corresponding one of said core tubes and having a stop plate positioned externally of said lower end of said corresponding one of said core tubes and being non-rotatably mounted to said base to thereby prevent said corresponding one of said core tubes from rotating relative to said base.

8. A showcase according to claim 7, wherein each of said upper assembly pins is non-rotatably received in an upper end of a corresponding one of said core tubes.

9. A showcase according to claim 8, wherein said guide bars include holding means for holding side edges of at least a pair of said glass panels.

10. A showcase according to claim 9, wherein said base includes channels sized and shaped so as to recieve a lower edge of at least one of said glass panels.

11. A showcase according to claim 10, wherein said base includes a plurality of holes, each of said holes being sized and shaped so as to receive said lower end of a corresponding one of said core tubes.

12. A showcase according to claim 1, wherein each of said cross members includes supporting means for supporting a shelf.

13. A showcase according to claim 1, wherein said at least one stabilizing frame includes a first stabilizing frame and a second stabilizing frame.

* * * * *